US010137969B2

(12) United States Patent
Lin

(10) Patent No.: US 10,137,969 B2
(45) Date of Patent: Nov. 27, 2018

(54) FACE MASK WITH MOUNT FOR IMAGING DEVICE

(71) Applicant: Sport Dimension Inc., Carson, CA (US)

(72) Inventor: Joseph Lin, Torrance, CA (US)

(73) Assignee: Sport Dimension Inc., Carson, CA (US)

( * ) Notice: Subject to any disclaimer, the term of this patent is extended or adjusted under 35 U.S.C. 154(b) by 315 days.

(21) Appl. No.: 15/078,155

(22) Filed: Mar. 23, 2016

(65) Prior Publication Data

US 2017/0274969 A1 Sep. 28, 2017

(51) Int. Cl.
*B63C 11/12* (2006.01)

(52) U.S. Cl.
CPC ..... *B63C 11/12* (2013.01); *B63C 2011/123* (2013.01)

(58) Field of Classification Search
CPC . A61F 9/02; A61F 9/026; A61F 9/029; B63C 11/12; B63C 2011/121; B63C 2011/123; B63C 11/126; A63B 33/002; A42B 1/24; A42B 1/242; A42B 1/244; A42B 1/245; A42B 3/30; A42B 3/306; A42B 3/04; A42B 3/0406; A42B 3/042; A42B 3/0433; A41D 13/1184
USPC ..... 2/422
See application file for complete search history.

(56) References Cited

U.S. PATENT DOCUMENTS 4,810,080 A * 3/1989 Grendol ..... A61F 9/02 351/138
5,638,552 A * 6/1997 Fujima ..... B63C 11/12 2/428
5,819,321 A * 10/1998 Wang ..... B63C 11/12 2/428
6,390,640 B1 * 5/2002 Wong ..... B63C 11/12 351/148
9,077,877 B2 * 7/2015 Fountain ..... F16M 13/04
2006/0048287 A1 * 3/2006 Kuo ..... B63C 11/12 2/426
2006/0081582 A1 * 4/2006 Hsieh ..... B63C 11/12 219/203
2008/0192114 A1 * 8/2008 Pearson ..... G03B 17/08 348/81
2009/0165191 A1 * 7/2009 Kuroda ..... A63B 33/00 2/428
2009/0307828 A1 * 12/2009 Ludlow ..... A61F 9/029 2/431

(Continued)

*Primary Examiner* — Amy Vanatta
(74) *Attorney, Agent, or Firm* — Raymond Sun

(57) ABSTRACT

An assembly includes a mask, a support piece, a filler piece and a mount piece. The mask has a frame that includes a right lens frame attached to a left lens frame by a bridge that supports a nosepiece, the frame further including a top surface and a connection region that is cut out from the top surface of the frame at the location of the bridge. The support piece is seated inside the connection region. The filler piece is seated inside the connection region and secured inside the connection region by the support piece. The mount piece has a bottom section, and a mount support extending vertically from the bottom section to receive a camera mount. The bottom section is seated inside the connection region and secured inside the connection region by the support piece when the mount piece is secured to the connection region.

12 Claims, 5 Drawing Sheets

(56) References Cited

U.S. PATENT DOCUMENTS

| | | | | |
|---|---|---|---|---|
| 2009/0313746 | A1* | 12/2009 | Wang | A61F 9/025 2/431 |
| 2015/0202088 | A1* | 7/2015 | Sanchez | A61F 9/029 2/439 |
| 2016/0271454 | A1* | 9/2016 | Lo | A63B 33/002 |

* cited by examiner

FACE MASK WITH MOUNT FOR IMAGING DEVICE

BACKGROUND OF THE INVENTION

1. Field of the Invention

The present invention relates to masks and mounting structures, and in particular, to a swim mask having a removable mount for an imaging device.

2. Description of the Prior Art

Diving and snorkeling have become popular recreational activities. Divers and snorkelers also enjoy taking photographs of underwater images and creatures.

To address this need for underwater photography, attempts have been made to provide diving masks that integrate an underwater camera. U.S. Pat. No. 9,077,877 discloses an integral (non-separable) mount, as well as a detachable mount. Unfortunately, both embodiments suffer from drawbacks. The integral mount cannot be removed, so it provides a bulky addition to a mask that a user would normally prefer to see less bulk or mass associated therewith. In addition, the attachment piece for the detachable mount is large and bulky, so that the user would be carrying a lot of additional mass and weight when it is used to support a camera.

Thus, there remains a need to provide a detachable mounting structure for a mask which overcomes the drawbacks identified above.

SUMMARY OF THE DISCLOSURE

In order to accomplish the objects of the present invention, there is provided an assembly having a mask, a support piece, a filler piece and a mount piece. The mask has a frame that includes a right lens frame attached to a left lens frame by a bridge that supports a nosepiece, with a lens retained inside each of the right lens frame and the left lens frame, the frame further including a top surface and a connection region that is cut out from the top surface of the frame at the location of the bridge. The support piece is seated inside the connection region. The filler piece can be seated inside the connection region and secured inside the connection region by the support piece, with the filler piece having a top surface that is flush with the top surface of the frame when the filler piece is secured at the connection region. The mount piece has a bottom section, and a mount support extending vertically from the bottom section, with two or more engagement tabs and a retainer engagement tab provided on the mount support and spaced apart so as to define open transverse slots therebetween suitable for the insertion of a camera mount. The bottom section can be seated inside the connection region and secured inside the connection region by the support piece when the mount piece is secured to the connection region.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

Figure 1:
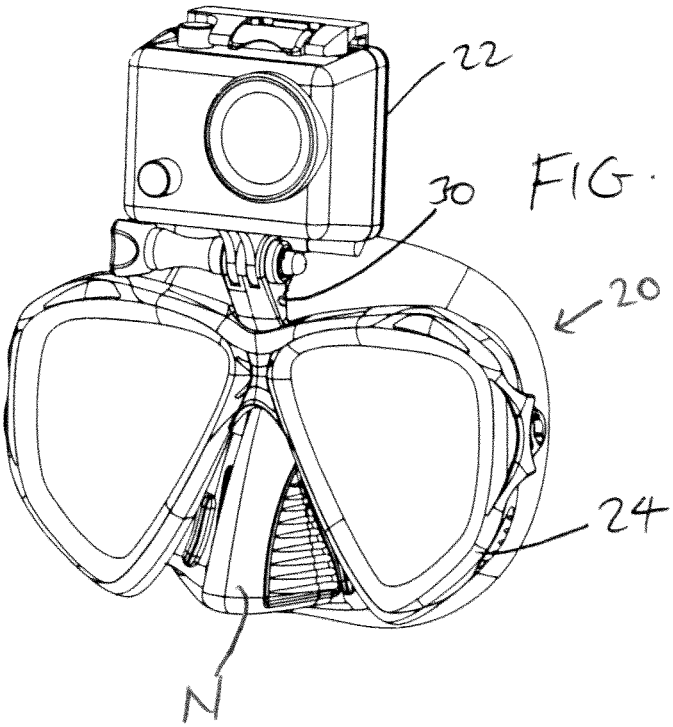
FIG. 1 is a perspective view of a mask according to one embodiment of the present invention, shown in use with a mount piece.
Figure 2:
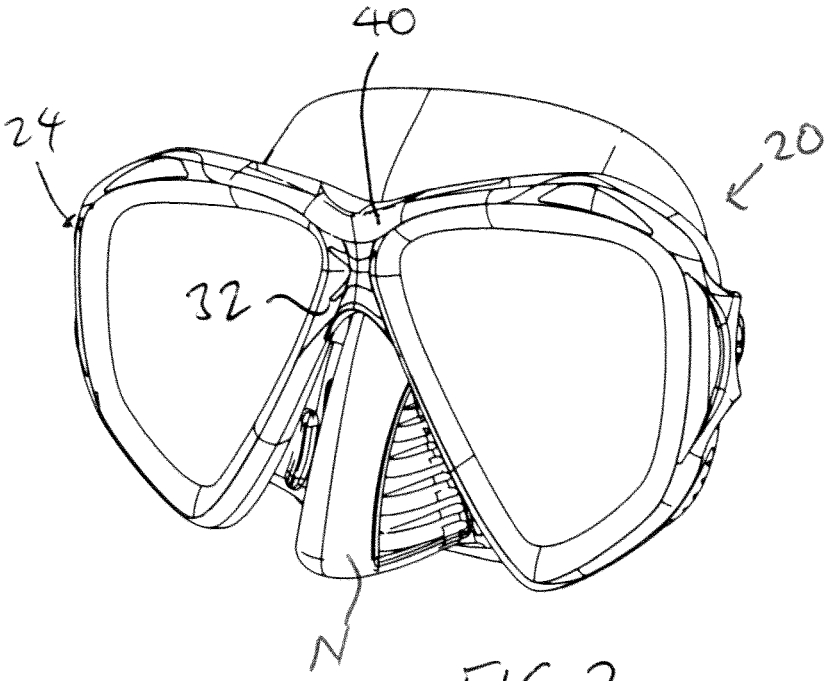
FIG. 2 is a perspective view of the mask of FIG. 1 shown in use with a filler piece.
Figure 3:
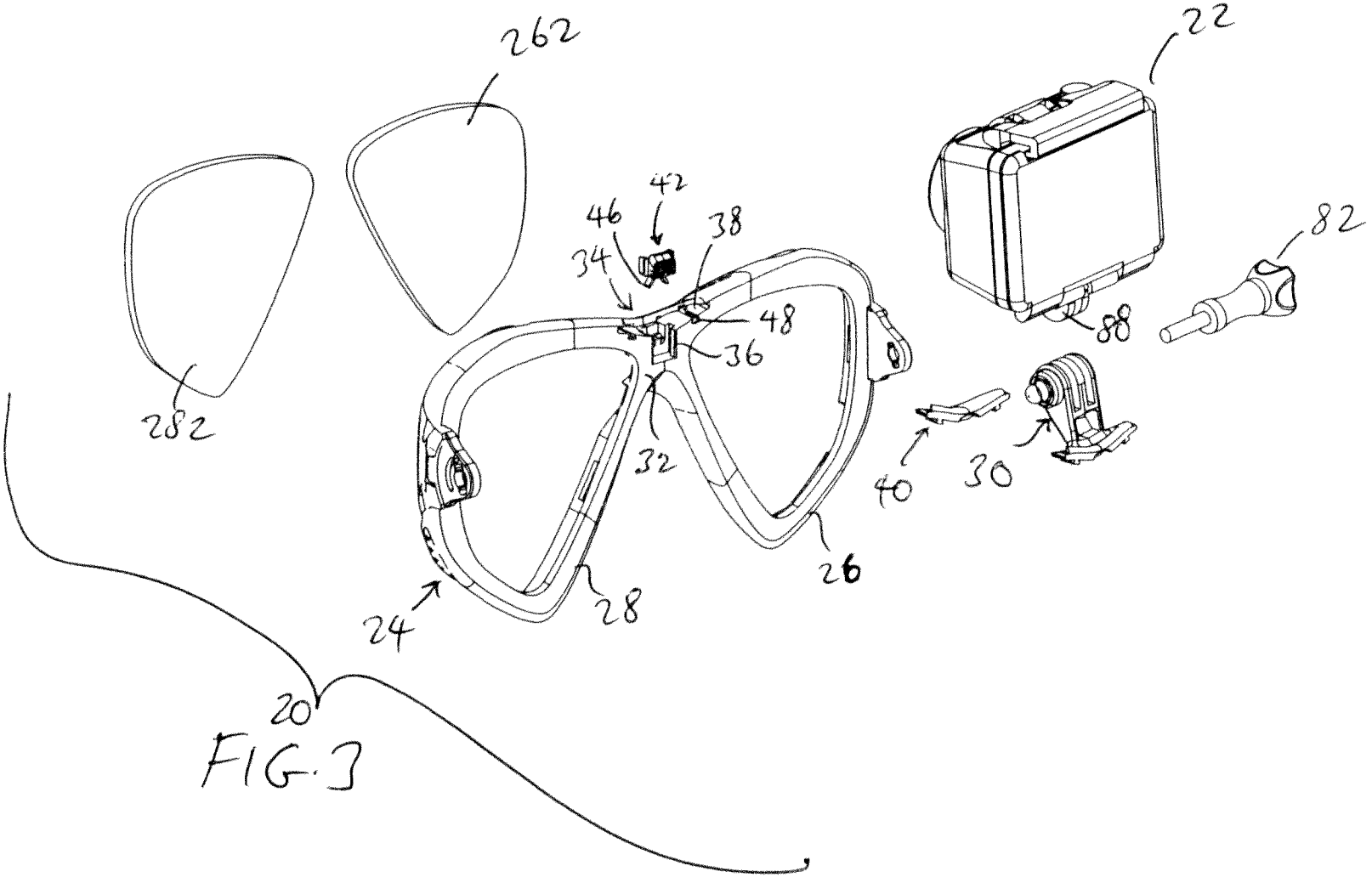
FIG. 3 is an exploded perspective view of the mask of FIG. 1 showing the mount piece, the filler piece and a camera.

Referring to FIGS. 1-3, the present invention relates generally to a mounting system for attaching an imaging device (e.g., a camera 22) to an active headwear (e.g., a diving mask 20). The mounting system includes a mask 20, a filler piece 40 and a mount piece 30. The mask 20 includes a headwear frame 24 to which can be attached a head strap (not shown) to form a diving mask 20. A digital camera or a video recorder 22 can be secured to a mount piece 30 in the mounting system to allow use thereof in a hands-free operating mode. When the camera 22 is not used, the mount piece 30 can be removed and replaced by a generic filler piece 40 that provides the frame 24 with a flush appearance so that the mask 20 appears to like any other conventional mask.

The frame 24 is suitable for attachment to a wearer's head using a head strap or a headband (not shown). The frame 24 includes a right lens frame 26 attached to a left lens frame 28 by a bridge 32 that supports a nosepiece N. The right lens frame 26 and the left lens frame 28 may be sized and shaped to accommodate a set of commercially-available lenses or inserts 262 and 282, respectively, including prescription lenses.

Figure 4A:
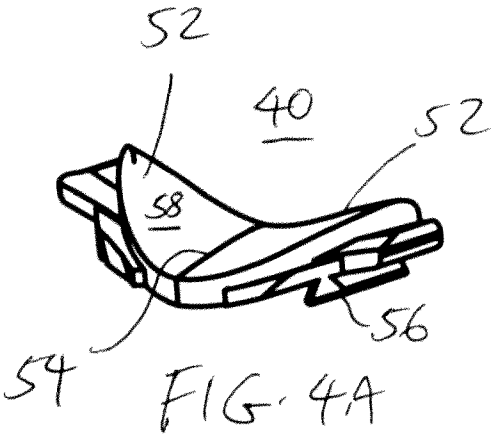
FIG. 4A is a front perspective view of the filler piece.
Figure 4B:
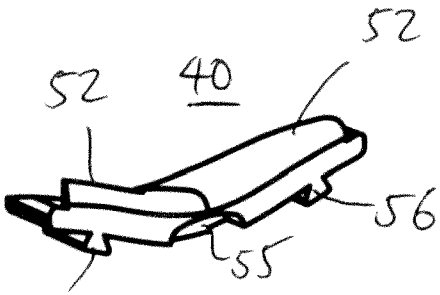
FIG. 4B is a rear perspective view of the filler piece.
Figure 4C:
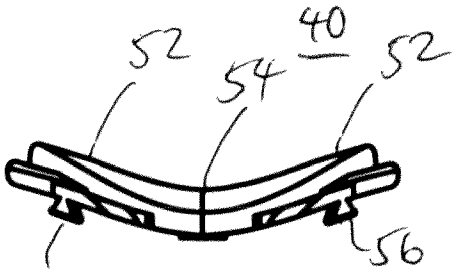
FIG. 4C is a front plan view of the filler piece.
Figure 5A:
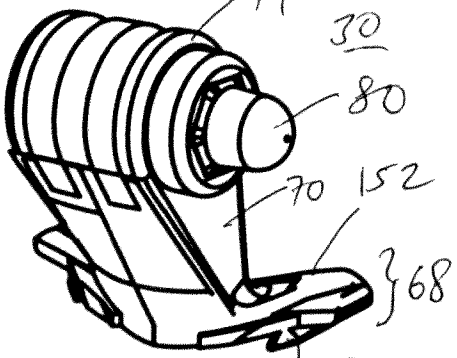
FIG. 5A is a front perspective view of the mount piece.
Figure 5B:
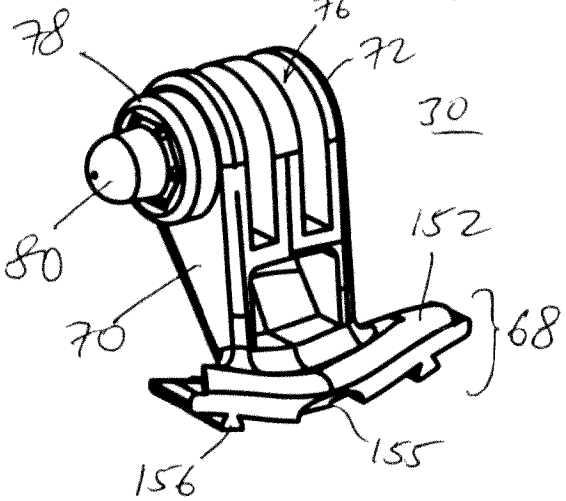
FIG. 5B is a rear perspective view of the mount piece.
Figure 5C:
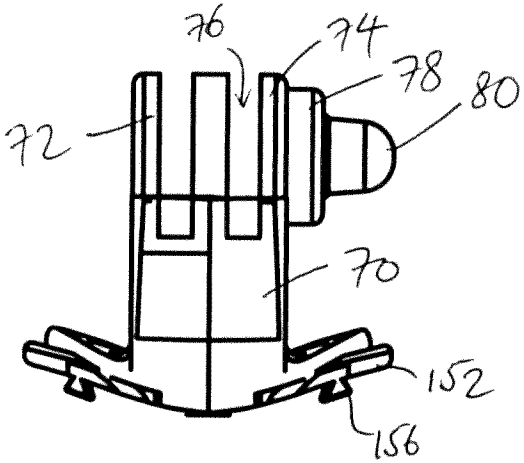
FIG. 5C is a front plan view of the mount piece.
Figure 7:
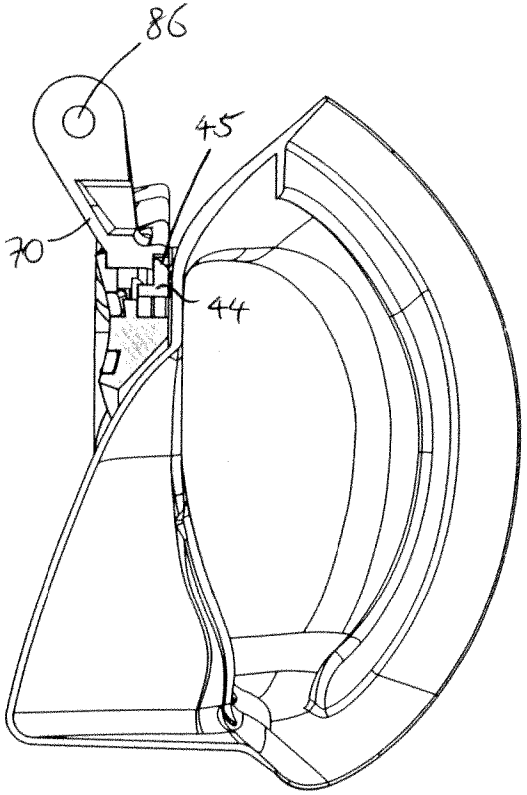
FIG. 7 is a cross-sectional view taken along the frame of the mask showing the mount piece coupled to the connecting region.
Figure 6:
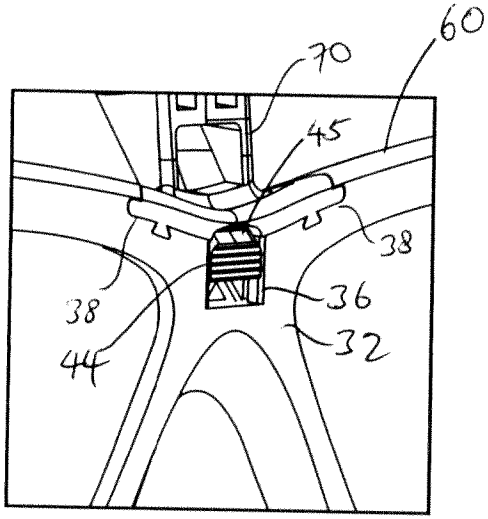
FIG. 6 is an enlarged rear perspective view of the frame of the mask showing the mount piece coupled to the connecting region.

The frame 24 is adapted to support and removably retain a mount piece 30 (see FIGS. 5A-5C) and a filler piece 40 (see FIGS. 4A-4C). The frame 24 has connector region 34 that is provided at the top of the bridge 32 for receiving either the mount piece 30 or the filler piece 40. As best seen in FIGS. 3 and 6, the connection region 24 has a central groove 36 with two winged sections 38 all cut out from the frame 24 at the bridge 32. Each winged section 38 also has a channel 48 provided therein. The channel 48 is configured so that its base has the widest diameter and its diameter gradually decreases towards the top like a pyramid shape. A biased support piece 42 is provided inside the groove 36. The support piece 42 has a body 44 with two flexible legs 46 provided at the lower part of the body 44, with the support body 44 normally seated inside the groove 36 with the flexible legs 46 naturally biasing the body 44 upwardly. Referring to FIG. 7, the body 44 is generally L-shaped having an angled upper edge 45.

The filler piece 40 has two angled wings 52 that extend from a central vertex 54. Each wing 52 has a leg 56 that has a pyramidal cross-section. A recessed edge 55 is cut out from the rear edge of the filler piece 40. The filler piece 40 is adapted to be slid into the winged sections 38 in a manner such that (i) the legs 56 are retained inside the corresponding channels 48, and (ii) the wings 52 are received in the winged sections 38 so that the top surface 58 of the wings 52 is flush with the top surface 60 of the frame 24. As a result, when installed in place, the filler piece 40 would look like it was part of the frame 24 and merely fills the cut-out space defined by the connector region 34. Also, the corresponding pyramidal shapes of the legs 56 and the channels 48 ensures that the filler piece 40 can only be slid into and out of the connector region 34, and cannot be lifted out upwardly. In addition, when the filler piece 40 is slid into the connector region 34, it pushes the angled upper edge 45 of the body 44, thereby pushing the body 44 of the support piece 42 downwardly against the natural bias of the legs 46, until the filler piece 40 is completely retained inside the groove 36 and the winged sections 38, and at that point, the angled upper edge 45 will be pushed against the recessed edge 55. The legs 46 function to naturally bias the body 44 upwardly so that the upper angled edge 45 is secured against the recessed edge 55 to secure the filler piece 40 at the connector region 34. FIG. 7 illustrates the same connection with respect to the mount piece 30.

When the filler piece 40 is to be removed, the user presses the upper angled edge 45 downwardly to overcome the bias of the legs 46, and allow the filler piece 40 to be slid out of the connector region 34.

The mount piece 30 has a bottom section 68 that is essentially identical to the filler piece 40 in that it has the wings 152, a recessed edge 155 and legs 156 that correspond to the wings 52, recessed edge 55 and legs 56, respectively. A mount support 70 extends vertically from the bottom section 68. Two or more engagement tabs 72 and a retainer engagement tab 74 may be provided on the mount support 70. The engagement tabs 72 and the retainer engagement tab 74 are spaced apart so as to define open transverse slots 76 suitable for the insertion of a camera mount 88 (as best seen in FIGS. 1 and 3), for example. The retainer engagement tab 74 may include a boss 78 with a recess configured to hold a fastening device, such as a threaded nut 80. Each of the engagement tabs 74 may include a through hole 86 (see FIG. 7), where the through holes 86 line up with the recess. This configuration allows for the insertion of a threaded fastener (not shown) into the through holes 86 so as to mate with the threaded nut 80 held in the recess, as is well-known in the relevant art.

The bottom section 68 of the mount piece 30 may be secured to, and removed from, the connecting region 134 in the same manner as described above for the filler piece 40.

An imaging device such as a camera 22 may be secured to the mount piece 30, where the camera 22 includes a camera mount 88 configured to mate with the engagement tabs 72 and the retainer engagement tab 74. After the camera mount 88 has been mated with the engagement tabs 72 and the retainer engagement tab 74, a fastener 82 may be placed through boss 78, retainer engagement tab 74 and engagement tabs 72 using the through holes (not shown) to more positively secure the camera 22 to the mask 20.

Thus, the present invention provides a mounting system for attaching an imaging device (e.g., a camera 22) to an active headwear (e.g., mask 20) which allows the mask 20 to be used as a normal mask 20 when no camera 22 is to be mounted, and yet provides a mount piece 30 that is small, light and non-bulky when compared to the available mounts. The smaller profile and size of the filler piece 40 and the mount piece 30 both overcome the drawbacks posed by the prior art.

The above detailed description is for the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices, components, mechanisms and methods are omitted so as to not obscure the description of the present invention with unnecessary detail.

What is claimed is:

1. An assembly, comprising:

a mask having a frame that includes a right lens frame attached to a left lens frame by a bridge that supports a nosepiece, with a lens retained inside each of the right lens frame and the left lens frame, the frame further including a top surface and a connection region that is cut out from the top surface of the frame at the location of the bridge;

a support piece seated inside the connection region; and a filler piece that is adapted to be seated inside the connection region and secured inside the connection region by the support piece, the filler piece having a top surface that is flush with the top surface of the frame when the filler piece is secured at the connection region; and a mount piece having a bottom section, and a mount support extending vertically from the bottom section, with two or more engagement tabs and a retainer engagement tab provided on the mount support and spaced apart so as to define open transverse slots therebetween suitable for the insertion of a camera mount, wherein the bottom section is adapted to be seated inside the connection region and secured inside the connection region by the support piece when the mount piece is secured to the connection region.

2. The assembly of claim 1, wherein the connection region has a central groove with two winged sections cut out from the frame at the bridge, each winged section having a channel provided therein.

3. The assembly of claim 2, wherein the filler piece has two angled wings, each wing having a leg that is slid into a corresponding channel when the filler piece is secured at the connection region.

4. An assembly, comprising:

a mask having a frame that includes a right lens frame attached to a left lens frame by a bridge that supports a nosepiece, with a lens retained inside each of the right lens frame and the left lens frame, the frame further including a top surface and a connection region that is cut out from the top surface of the frame at the location of the bridge, wherein the connection region has a central groove;

a support piece seated inside the connection region; and a filler piece that is seated inside the connection region and secured inside the connection region by the support piece, the filler piece having a top surface that is flush with the top surface of the frame when the filler piece is secured at the connection region;

wherein the support piece has a body with at least one flexible leg provided at a lower part of the body, and with the support body normally seated inside the groove with the at least one flexible leg naturally biasing the body upwardly to push the body against the filler piece.

5. The assembly of claim 4, wherein the support piece has a top, and wherein a recessed edge is cut out from a rear edge of the filler piece, and the top of the support piece engages the filler piece at the recessed edge.

6. An assembly, comprising:

a mask having a frame that includes a right lens frame attached to a left lens frame by a bridge that supports a nosepiece, with a lens retained inside each of the right lens frame and the left lens frame, the frame further including a top surface and a connection region that is cut out from the top surface of the frame at the location of the bridge;

a support piece seated inside the connection region;

a filler piece that is seated inside the connection region and secured inside the connection region by the support piece, the filler piece having a top surface that is flush with the top surface of the frame when the filler piece is secured at the connection region;

wherein the connection region has a central groove with two winged sections cut out from the frame at the bridge, each winged section having a channel provided therein;

wherein the filler piece has two angled wings, each wing having a leg that is slid into a corresponding channel when the filler piece is secured at the connection region; and wherein each channel is configured so that its base has the widest diameter and its diameter gradually decreases towards the top in a pyramid shape cross-section, and each leg has a pyramidal cross-section that corresponds with the pyramid shape of each channel to allow a leg to be slid into and out of the channel without allowing the leg to be lifted out of the channel.

7. An assembly, comprising:

a mask having a frame that includes a right lens frame attached to a left lens frame by a bridge that supports a nosepiece, with a lens retained inside each of the right lens frame and the left lens frame, the frame further including a top surface and a connection region that is cut out from the top surface of the frame at the location of the bridge;

a support piece seated inside the connection region; and a mount piece having a bottom section, and a mount support extending vertically from the bottom section, with two or more engagement tabs and a retainer engagement tab provided on the mount support and spaced apart so as to define open transverse slots therebetween suitable for the insertion of a camera mount, wherein the bottom section is seated inside the connection region and secured inside the connection region by the support piece when the mount piece is secured to the connection region.

8. The assembly of claim 7, wherein the connection region has a central groove with two winged sections cut out from the frame at the bridge, each winged section having a channel provided therein.

9. The assembly of claim 8, wherein the bottom section has two angled wings, each wing having a leg that is slid into a corresponding channel when the mount piece is secured at the connection region.

10. The assembly of claim 9, wherein the support piece has a body with at least one flexible leg provided at a lower part of the body, and with the support body normally seated inside the groove with the at least one flexible leg naturally biasing the body upwardly to push the body against the bottom section.

11. The assembly of claim 10, wherein the support piece has a top, and wherein a recessed edge is cut out from a rear edge of the bottom section, and the top of the support piece engages the bottom section at the recessed edge.

12. The assembly of claim 9, wherein each channel is configured so that its base has the widest diameter and its diameter gradually decreases towards the top in a pyramid shape cross-section, and each leg has a pyramidal cross-section that corresponds with the pyramid shape of each channel to allow a leg to be slid into and out of the channel without allowing the leg to be lifted out of the channel.

* * * * *